United States Patent [19]

Borio et al.

[11] Patent Number: 4,552,077

[45] Date of Patent: Nov. 12, 1985

[54] INTEGRATED COAL CLEANING PROCESS

[75] Inventors: Donald C. Borio, New Britain; Richard W. Borio, Somers; Gilbert L. Hale, Granby, all of Conn.; Arun K. Mehta, Los Altos, Calif.; Arnold L. Tyler, Torrington, Conn.

[73] Assignee: Combustion Engineering, Inc., Windsor, Conn.

[21] Appl. No.: 625,271

[22] Filed: Jun. 27, 1984

[51] Int. Cl.[4] ..... F23G 5/04

[52] U.S. Cl. ..... 110/347; 110/232; 110/342; 44/51

[58] Field of Search ..... 110/347, 342, 343, 232, 110/218, 238, 106; 44/51

[56] References Cited

U.S. PATENT DOCUMENTS 4,191,115 3/1980 Yang et al. ..... 110/218
4,213,407 7/1980 Headley ..... 110/238
4,387,654 6/1983 Binasik et al. ..... 110/347
4,462,794 7/1984 Pfeffer, III et al. ..... 110/347

FOREIGN PATENT DOCUMENTS 1596682 8/1981 United Kingdom ..... 44/51

*Primary Examiner*—Henry C. Yuen
*Assistant Examiner*—John Kwon
*Attorney, Agent, or Firm*—Troxell K. Snyder

[57] ABSTRACT

An integrated method of removing alkali metal compounds from sulfur-bearing coal is disclosed. The coal is comminuted (4) and mixed (10) with water (8) to form a slurry (12). In the preferred embodiment, the slurry (12) is comingled with an $SO_2$-bearing gas (16) in a transport pipeline (52) to form an acidic slurry which dissolves the alkali compounds out of the coal. The slurry is then separated (22) into a solid portion (24) and a liquid portion (26), the solid portion (24) being combusted (34) to form the $SO_2$-bearing gas (16).

2 Claims, 2 Drawing Figures

INTEGRATED COAL CLEANING PROCESS

FIELD OF THE INVENTION

This invention pertains to a process for beneficiating coal, and more particularly, to a process for beneficiating coal through the removal of alkali metals therefrom.

BACKGROUND OF THE INVENTION

The presence of alkali metals in various coals has long been known to cause problems in the combustion of such coals by contributing to the fouling of the heating surfaces present within coal-fired steam generators and furnaces. Sodium, for example, exists in a vaporous state at typical coal combustion temperatures, usually in excess of 2500F in a furnace, but reverts to a liquid state further downstream when the combustion products are cooled by steam generating or steam superheating heat transfer surfaces. The sodium deposits on the heating surfaces acting as a binder for flyash or other noncombusted material in the gas stream. Sufficient quantities of material deposited on the heat transfer surfaces reduces heat transfer as well as furnace efficiency.

It has been known in the art to dissolve alkali metals such as sodium and potassium from coal by immersing the raw coal into an acidic liquid. The acid reacts with the alkali metals to form soluble compounds which are dissolved into the acid and out of the coal.

While the exact mechanism of this dissociation and dissolution may vary widely depending upon the type of coal being beneficiated, typically most alkali metals are bound up within humates, an organic material inherent in most high alkali coals.

Although known in the art as a method for reducing the alkali content of coal, this acid wash process has not been widely used to beneficiate coal. The reasons for this lack of use include the requirement for a large amount of water and acid necessary to dissolve the alkali metals from the coal, as well as the need to dewater and separate the beneficiated coal from the acid wash. Coal slurry transport systems currently in use or projected for use provide a flow stream of coal slurried in water, as well as separation and dewatering facilities upon arrival at the combustion site. In such a system as this, beneficiation may be accomplished by acidifying the transported coal slurry and later disposing of the separated liquid portion bearing the dissolved alkali compounds.

What is required is a method for acidifying the slurried coal and for treating the separated, alkali bearing liquid portion of the acidic slurry prior to release or other disposal.

SUMMARY OF THE INVENTION

The process according to the present invention provides an integrated system for beneficiating coal through the removal of alkali metals, such as sodium and potassium. The $SO_2$-bearing flue gas generated by combusting the beneficiated, sulfur-bearing coal is comingled with water whereupon the $SO_2$ reacts to form a sulfur-based acid, such as sulfurous and/or sulfuric acid. The acid solution is contacted with the comminuted coal feed and the mixture maintained at a pH of 5 or less.

The acidic mixture, or slurry, of coal and water reacts to dissociate alkali metals bound up within the coal, forming dissolved alkali-sulfur compounds within the liquid portion of the slurry. Subsequent separation of the liquid and solid portions results in a stream of beneficiated coal having a reduced alkali metal content, and a liquid waste stream for eventual disposal.

By using the $SO_2$ generated by the combustion of the beneficiated coal in the beneficiation process, the process according to the present invention does not require an outside acid source.

Moreover, by collecting the basic ash compounds generated by combustion of the beneficiated coal and mixing these with the separated liquid portion of the acidic slurry, any remaining acidity in the liquid portion may be neutralized prior to disposal in an environmentally acceptable manner.

It is a still further feature of the process according to the present invention that the process is well adapted for integration into a coal slurry transport system wherein the coal is both transported and cleaned prior to arrival at the combustion site.

BRIEF DESCRIPTION OF THE DRAWING FIGURES

DETAILED DESCRIPTION OF THE PREFERRED EMBODIMENT

Figure 1:
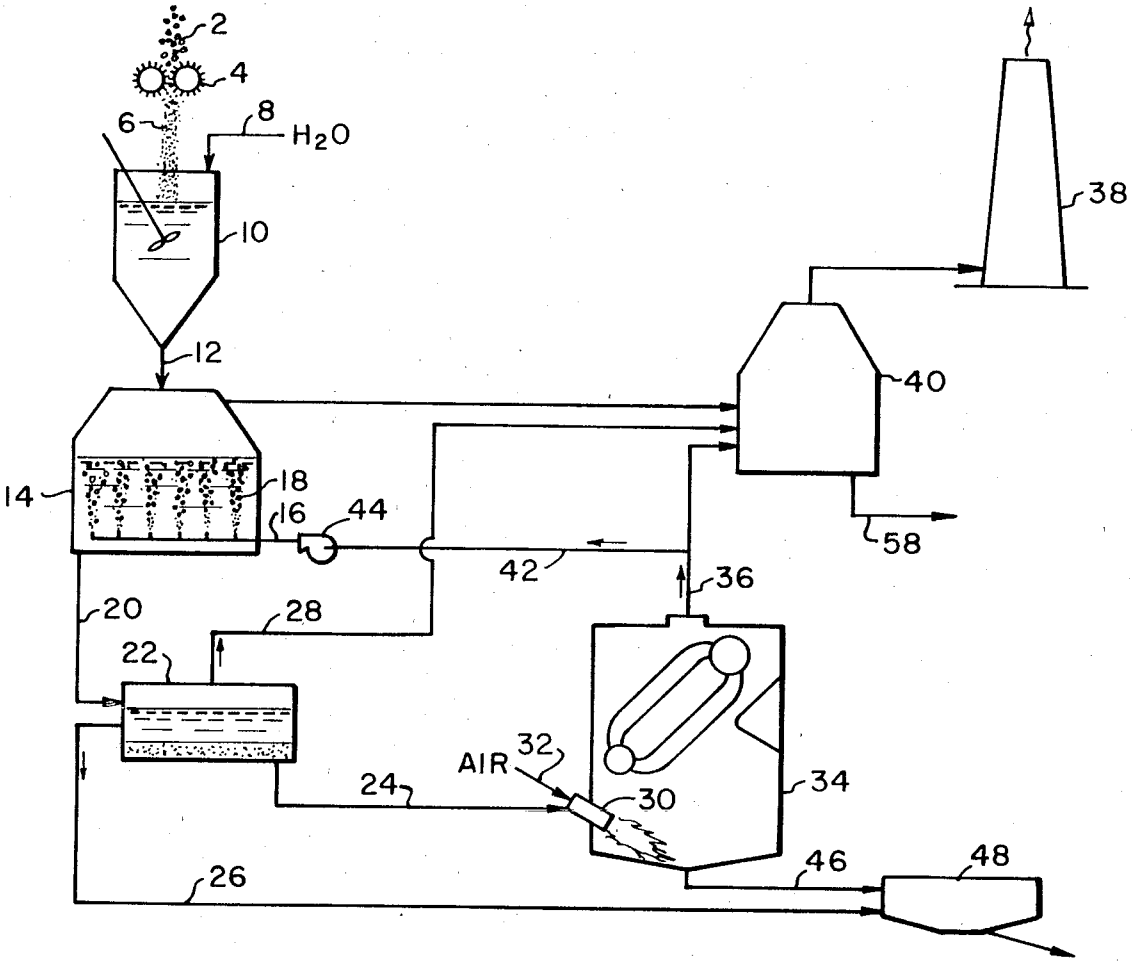
FIG. 1 is a schematic representation of an alternative embodiment of the process according to the present invention.

Referring now to drawing FIG. 1, an alternative embodiment of the process according to the present invention will now be described. In the figure, a stream of raw coal 2 is comminuted by grinding means 4 into a stream of fine coal particles 6. The comminuted particles 6 are of a size sufficiently small to permit them to be slurried with water 8 in an agitated vessel 10 or other suitable means. A typical average particle size for the coal particles would be on the order of 300 microns diameter or less.

The coal water slurry 12, typically consisting of up to 60% solids by weight fraction, next enters a holding tank or contactor 14. In the contactor 14 a quantity of $SO_2$-bearing gas 16 is introduced and allowed to percolate through the stored slurry 18. During this comingling process, the $SO_2$ present in the $SO_2$-bearing gas 16 reacts with the water portion of the coal water slurry 18 to form sulfur-based acids, such as sulfurous acid, $H_2SO_3$, with a portion oxidized to sulfuric acid, $H_2SO_4$.

For acidic conditions having a pH of 5 or less, it has been found that any alkali metal components present within the raw coal will be dissociated therefrom and enter the liquid portion of the acidic slurry as dissolved sulfur compounds. These compounds, such as $Na_2SO_4$, $NaHSO_3$, $K_2SO_4$ or $KHSO_3$, result from the breakup of humates and other structures within the coal particle that contain alkali metals.

Following holding within the contactor 14 for a period of time sufficient to dissociate the desired quantity of alkali metals from the raw coal, the acidic slurry 20 is conveyed to a separator 22 wherein the solid portion 24 and the liquid portion 26 are separated. The solid portion 24 consists of dewatered sulfur-bearing coal which has experienced a significant reduction of its original alkali metal content due to contact with the acidic liquid portion in the contactor 14.

The length of time required to leach the alkali metals out of the coal varies dependent on the structure and composition of the coal as well as the concentrations of acid in the liquid portion 26. Typically, 90% of the leachable alkali metals will be dissolved out in 15 to 20 minutes.

The liquid portion 26 contains the dissolved alkali metal-sulfur compounds, as well as any uncombined sulfurous or sulfuric acid which may remain. Although a perfectly balanced process would result in an essentially neutral liquid waste stream 26, it is anticipated in practice that some sulfurous or sulfuric acid will remain in the liquid portion 26 exiting the separator 22.

Also shown is a gaseous waste line 28 which represents any off gases or other such ventings from the separator 22. The beneficiated coal 24 enters a burner 30 along with atmospheric air 32 or other comparable oxidant. It is typical to absorb any heat generated by this combustion in a steam generator or other furnace shown schematically by reference numeral 34. The flue gas 36 exiting the furnace 34 contains $S0_2$, a result of the oxidation of the sulfur remaining in the beneficiated coal 24. This $S0_2$ is typically removed, prior to release to the atmosphere through the stack 38, by passage through a limestone or other alkaline scrubber 40 wherein the $S0_2$ reacts with a countercurrent slurry of calcium hydroxide or calcium carbonate to form a calcium-sulfur solid compound which may be disposed of in a sanitary landfill or by other means.

In the process according to the present invention, at least a portion 42 of the sulfur bearing gas exiting the furnace 36 is routed to the contactor 14 to provide the $S0_2$-bearing gas 16 which is comingled with the contained slurry 18. As shown in the schematic, a fan or other gas blower 44 would likely be necessary to effect this transfer.

It is also within the scope of the present invention to comingle the water 8 and the $S0_2$-bearing gas 16 forming an acid stream which may then be mixed with the comminuted coal 6 to form an acidic slurry 20. This alternate process (not shown, is substantially equivalent to the slurry preparation steps shown in FIG. 1.

Thus, one undesirab1e contaminant present within coal, sulfur, is used to assist in removal of another undesirable component, alkali metals. By using the $S0_2$ generated by combusting the low alkali, beneficiated coal, the present invention not only provides an effective source for acidifying the coal-water slurry 12, but also serves to reduce the gas input to the scrubber 40, with an attendant potential decrease in equipment size and other cost saving effects.

Additionally, it is within the scope of the present invention to remove the ash 46 which remains after the combustion of the coal 24 in the furnace 34, and to mix this removed ash 46 with the separated liquid portion 26. Ash collected from coal-firing furnaces typically contains basic compounds which will readily neutralize any acid present in the separated liquid portion 26. The neutralizer 48 would be similar to an existing ash disposal pit or holding tank which accepts slurried ash from a typical furnace ash or slag hopper.

Any off gases 28 from the separator 22 would typically be passed either into the scrubber 40 or directly to the stack 38. The exact choice of route would depend on the concentration of sulfur compounds present within this gas stream 28.

The above-described alternative embodiment of the process according to the present invention thus presents a completely integrated system for removing alkali metals from raw coal. The system uses the waste streams from the combustion reaction, $S0_2$ and ash, to effect the removal of the alkali metals from the raw coal feed as well as to neutralize the acidic liquid portion separated from the acidic slurry following the removal of the alkali metals from the coal particles.

Figure 2:
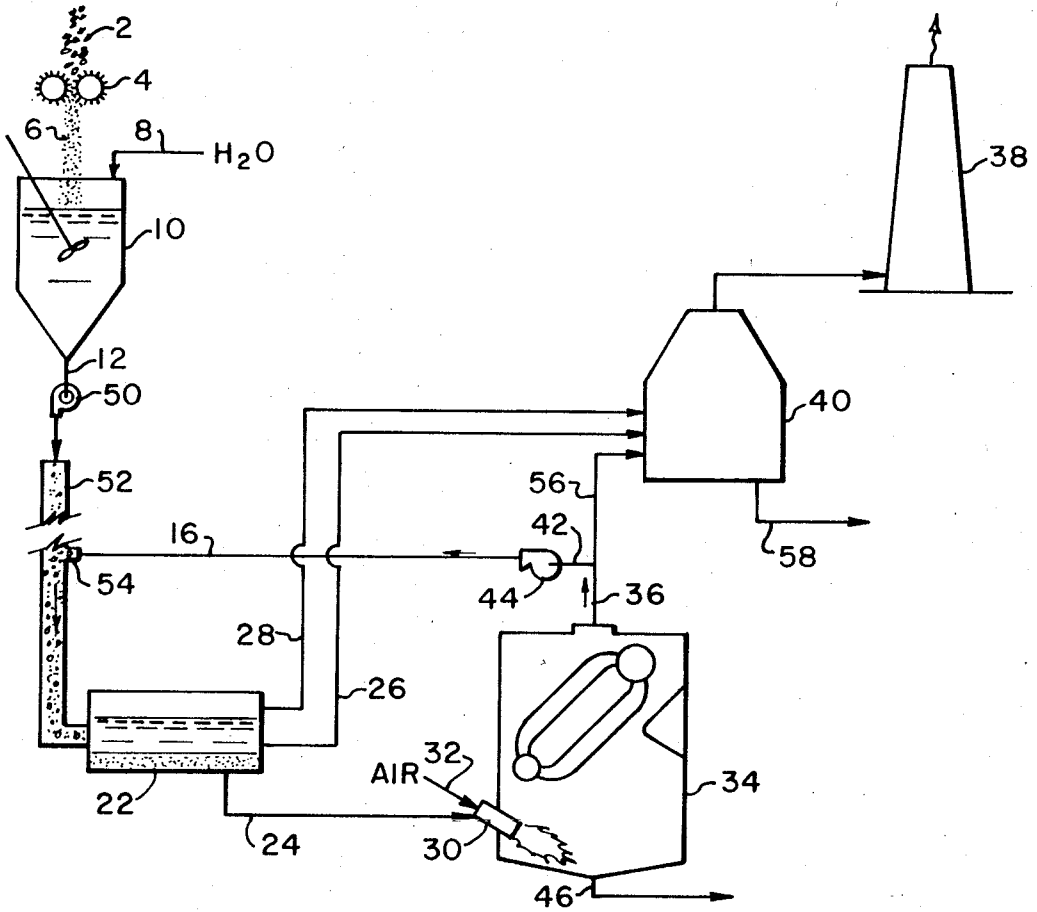
FIG. 2 is a schematic representation of the preferred embodiment of the process according to the present invention.

Turning to FIG. 2 the preferred embodiment of the process according to the present invention will now be described. FIG. 2 again shows raw coal 2 being comminuted 4 to form a fine particle stream 6 as described in relation to the alternative embodiment. As in the alternative embodiment, the fine coal stream 6 is mixed with water 8 in an agitator or other vessel 10 to produce a slurry 12 which may then be pumped 50 into a coal slurry transport pipeline 52. Coal slurry transport pipelines, although relatively old in the art of coal bulk transfer, are only recently gaining acceptance in the United States. With these pipelines it is possible to transport coal over great distances in much the same manner as other liquid fuels or chemicals are transported.

In the preferred embodiment, the $S0_2$ bearing gas 16 is injected into the coal slurry pipeline 52 at a point 54 which is spaced apart from the separator 22 by a distance sufficient to permit formation of sulfurous and sulfuric acid in the liquid portion of the coal slurry, resulting in a pH of 5 or less, and the subsequent dissociation and dissolution of the alkali metals from the coal particles into the liquid portion. In a typical coal slurry pipeline supplying a large generating station with coal transported from a mine or other coal supply point, the injection of the $S0_2$ bearing gas takes place within a reasonable distance of the separation site, approximately on the order of 1 to 2 miles or less, depending upon the velocity of the slurry and the dissolving rate of the alkali metals.

Upon arrival at the final destination, the coal slurry is separated 22 into a solid portion 24, a liquid portion 26 and possibly a gaseous portion 28. As in the alternative embodiment, the beneficiated coal stream 24 is combusted 30 with air 32 in a furnace 34 for the generation of heat as well as an $S0_2$ bearing flue gas 36.

A portion of the $S0_2$ bearing flue gas 42 is transported to the upstream injection point 54, possibly under the influence of the blower 44 as shown in the drawing figure. Any undiverted flue gas 56 enters the alkaline scrubber 40 before exiting from the stack 38 into the environment.

The preferred embodiment shown in FIG. 2, which also includes within the scope of disclosure the mixing of the separated liquid portion 26 with the collected ash 46 for neutralization of any remaining acid prior to disposal, shows the alternate routing of the separated liquid portion 26 into the alkaline scrubber 40 wherein the acidic liquid portion is neutralized by contact with the basic calcium or other alkaline compounds present therein. The dissolved alkali metals present in the liquid portion 26 therefore eventually follow the disposal route of the calcium sulfate sludge from the alkaline scrubber 40.

The present invention thus presents a completely integrated system whereby waste products and other undesirable compounds resulting from the combustion of coal are used to beneficiate the coal prior to combustion in order to avoid undesirable fouling of the furnace or heat transfer surfaces which may be present therein.

We claim:

1. A process for beneficiating a sulfur-bearing coal, comprising the steps of:

comminuting said coal and combining the comminuted coal with water to form a neutral liquid-solid slurry;

pumping the neutral slurry into a conduit for transporting the comminuted coal from a first location to a second location;

injecting an $SO_2$-bearing gas into the conduit upstream of the second location to form an acidic liquid-solid slurry, said acidic slurry having a pH of 5 or less;

separating, upon arrival at the second location, the liquid portion of said acidic slurry containing any alkali metals dissolved from the comminuted coal from the solid portion of said acidic slurry containing the now-beneficiated coal;

combusting the beneficiated coal in air, oxidizing the sulfur present therein, thereby generating an $SO_2$-bearing gas; and using a portion of the $SO_2$-bearing gas generated by the combustion step for the step of injecting an $SO_2$-bearing gas into the conduit.

2. The process of claim 1, further comprising the steps of:

collecting the ash generated from the coal in the combustion step; and combining the collected ash and the separated liquid portion of said acidic slurry to form a neutral mixture for disposal.

* * * * *